US006824406B1

(12) United States Patent
Sharples et al.

(10) Patent No.: US 6,824,406 B1
(45) Date of Patent: Nov. 30, 2004

(54) ELECTRICAL CONNECTOR ASSEMBLY

(75) Inventors: Robert J Sharples, Niles, OH (US); John Wicks, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 15 days.

(21) Appl. No.: 10/606,919

(22) Filed: Jun. 26, 2003

(51) Int. Cl.[7] ..... H01R 13/62
(52) U.S. Cl. ..... 439/157; 439/345; 439/352
(58) Field of Search ..... 439/157, 152, 439/345, 352, 372, 154–156, 347, 341–343, 488

(56) References Cited

U.S. PATENT DOCUMENTS

| | | | | |
|---|---|---|---|---|
| 5,681,175 | A | * 10/1997 | Busse et al. | 439/157 |
| 6,086,385 | A | 7/2000 | Wang et al. | |
| 6,142,813 | A | 11/2000 | Cummings et al. | |
| 6,162,085 | A | 12/2000 | Chugh et al. | |
| 6,168,445 | B1 | * 1/2001 | Seutschniker et al. | 439/157 |
| 6,171,146 | B1 | 1/2001 | Fink et al. | |
| 6,179,658 | B1 | 1/2001 | Gunay et al. | |
| 6,203,364 | B1 | 3/2001 | Chupak et al. | |
| 6,208,233 | B1 | 3/2001 | Stein, Sr. et al. | |
| 6,213,795 | B1 | * 4/2001 | Drescher et al. | 439/157 |
| 6,217,354 | B1 | * 4/2001 | Fencl et al. | 439/157 |
| 6,247,951 | B1 | 6/2001 | Di Liello et al. | |
| 6,247,965 | B1 | 6/2001 | Cummings et al. | |
| 6,305,957 | B1 | 10/2001 | Fink et al. | |
| 6,338,651 | B1 | 1/2002 | Svette, Jr. et al. | |
| 6,345,706 | B1 | 2/2002 | Oliver et al. | |
| 6,345,995 | B1 | * 2/2002 | Bigotto et al. | 439/157 |
| 6,406,307 | B2 | 6/2002 | Bungo et al. | |
| 6,443,137 | B1 | 9/2002 | Kraft et al. | |
| 6,454,060 | B1 | 9/2002 | Lisenker et al. | |
| 6,494,751 | B1 | 12/2002 | Morello et al. | |
| 6,508,666 | B1 | 1/2003 | Francis | |
| 6,533,588 | B1 | 3/2003 | Woith et al. | |
| 6,533,611 | B2 | 3/2003 | Morello et al. | |
| 6,535,396 | B1 | 3/2003 | Degenkolb et al. | |
| 6,556,118 | B1 | 4/2003 | Skinner | |
| 6,558,176 | B1 | * 5/2003 | Martin et al. | 439/157 |
| 6,565,372 | B2 | 5/2003 | Bakker et al. | |
| 6,578,444 | B1 | 6/2003 | Wendelin | |

* cited by examiner

*Primary Examiner*—Gary Paumen
*Assistant Examiner*—Edwin A. Leon
(74) *Attorney, Agent, or Firm*—David P. Wood

(57) ABSTRACT

An electrical connector assembly has a housing and two slide assist members that are slideably supported by the housing. The slide assist members each include at least one mating slot adapted to receive a mating portion of a mating connector. A U-shaped slide assist lever having first and second spaced apart arms is pivotally interconnected with the housing and the slide assist members to move the slide assist members and facilitate mating with the mating connector. Each slide assist member includes a notch and each lever arm includes a protrusion that mates with the corresponding notch when the slide assist member is in an engaged location and the lever is in an engaged position. If the lever is disconnected from at least one of the slide assist members and an attempt to move the lever from a pre-staged position to the engaged position does not correspondingly move the disconnected slide assist member from a pre-staged location to the engaged location, the protrusion functions to interferingly abut the adjacent disconnected slide assist member thereby preventing the lever from moving to the engaged position.

21 Claims, 4 Drawing Sheets

ELECTRICAL CONNECTOR ASSEMBLY

TECHNICAL FIELD

The present invention generally relates to electrical connectors and more particularly to an electrical connector having a lever whereby mating and unmating of the connector with a second connector is effected by movement of a slide assist mechanism caused by rotation of the lever.

INCORPORATION BY REFERENCE

U.S. Pat. No. 6,270,376 to Fmk et al, which is assigned to the assignee of the present invention, is hereby incorporated by reference herein in order that certain details of electrical connector assemblies unrelated to the present invention are not repeated herein.

BACKGROUND OF THE INVENTION

Electrical connectors with a lever and slide assist mechanism for mating and unmating with a second connector are known in the art U.S. Pat. No. 5,681,175 to Busse et al, U.S. Pat. No. 6,217,354 to Fencl, et al. and the previously cited '376 patent to Fmk et al., disclose such connectors. Such connectors typically have a lever that is substantially U-shaped and is pivotally mounted on the housing of the connector. A pair of slide assist mechanisms are also mounted on the same housing and slide on pivoting of the lever. The slide assist mechanisms have cam surfaces which engage corresponding cam followers on the housing of the second connector. Pivoting of the lever causes the slide assist mechanisms to slide to mate or unmate the electrical connector with the second connector.

One of the problems with such assemblies is that the lever arms have a tendency to spread apart under high mating force loads encountered during mating of the connectors when rotational forces are applied to the lever. Another, and often related, problem involves one or both lever arms becoming disengaged from the adjacent slide assist mechanism. Consequently, an operator could rotate the lever without causing the connectors to fully mate. In such a situation, the rotated lever provides an illusion that the connectors are fully mated and does not provide the operator with feedback to take corrective action.

SUMMARY OF THE INVENTION

The present invention provides alternatives and advantages over the prior art in that it includes an electrical connector assembly having a slide assist member and a lever with a slide sensing mechanism which cooperate to prevent the lever from moving from a first (pre-staged) position to a second (engaged) position when the lever becomes disengaged from the slide assist member. In a preferred embodiment, the slide sensing mechanism includes a slide sensing protrusion located on each arm of a U-shaped lever which mates with a notch in the corresponding slide assist member when each slide assist member is in a second (engaged) location and the lever is in a second (engaged) position.

If at least one of the slide assist mechanisms is disengaged from the lever, the slide sensing protrusion functions to abut the disengaged slide assist member when an attempt to is made to move the lever from the first (pre-staged) position to the second (engaged) position. This prevents movement of the lever to the second (engaged) position when each of the slide assist members do not correspondingly move from the first (pre-staged) location to the second (engaged) location.

The preferred embodiment further includes a connector position assurance (CPA) mechanism which includes a CPA lock that cannot be installed unless the lever is in the second (engaged) position.

A feature of the present invention is that if a slide assist member becomes disengaged from the lever, the slide sensing mechanism prevents the lever from moving to the second (engaged) position where it could provide an operator with a false illusion that the connector is fully mated when it is not or where it could enable a CPA lock to be installed or actuated when the connector is not fully mated.

A feature of a preferred embodiment of the present invention is that if the lever becomes disengaged from the slide assist member, the lever can be reengaged by moving the lever back to the first (pre-staged) position.

These and other features and advantages of the present invention will become apparent from the following brief description of the drawings, detailed description, and appended drawings.

BRIEF DESCRIPTION OF THE DRAWINGS

The present invention will now be described, by way of example, with reference to the accompanying drawings, in which.

DETAILED DESCRIPTION OF THE INVENTION

Figure 1:
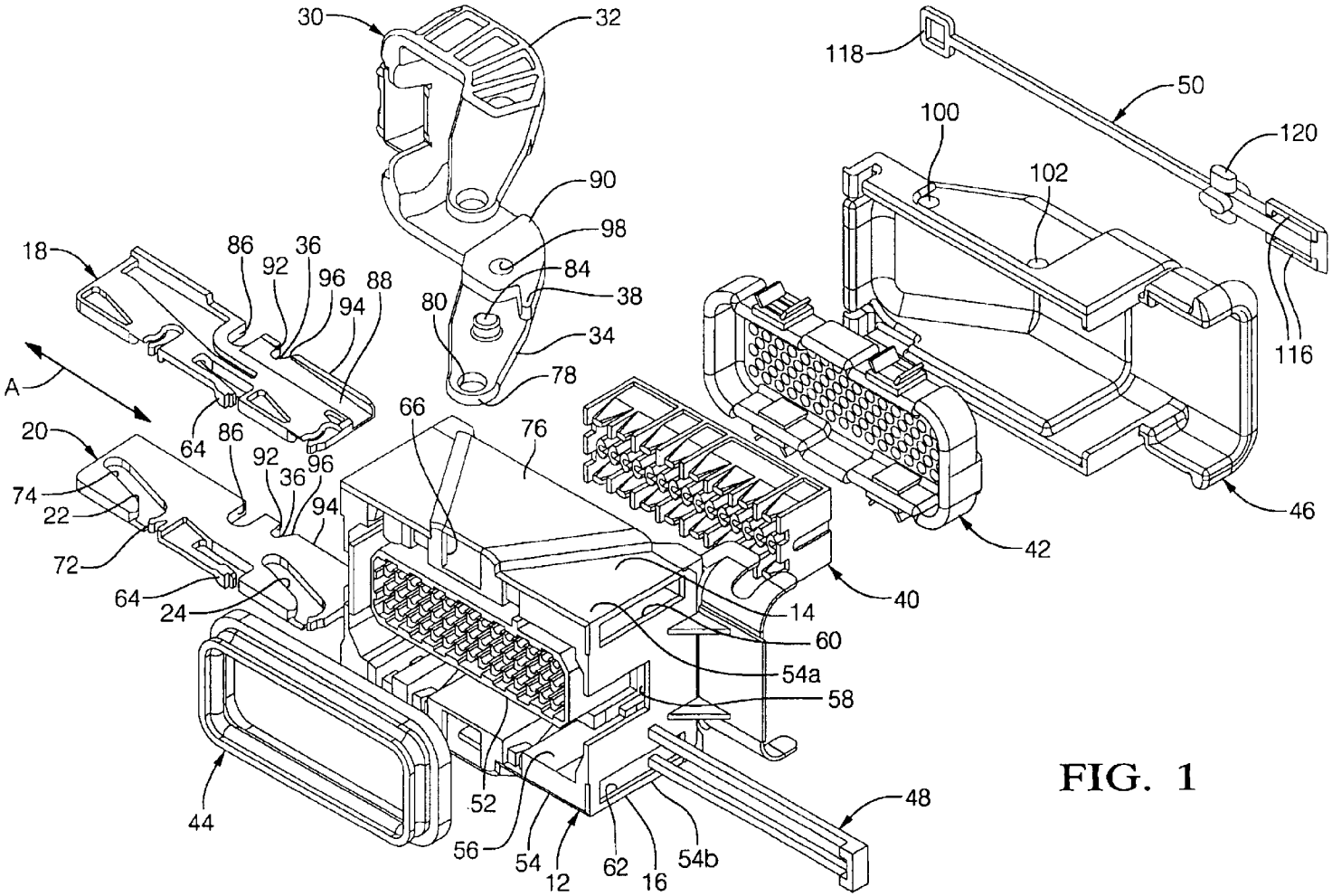
FIG. 1 is an exploded perspective view of a connector assembly according to be present invention.

Referring to the figures wherein like numerals refer to like elements throughout the several views, a preferred embodiment of an electrical connector assembly 10 of the present invention includes a housing 12 having opposing side walls 14, 16. First and second slide assist members 18, 20 are slideably supported on the opposing walls 14, 16, each slide assist member 18, 20 including at least one mating slot 22, 24 adapted to receive a mating portion 26 of a mating connector 28 (as shown on FIGS. 4 and 5). A slide assist lever 30 is pivotably interconnected with the housing 12. The slide assist lever 30 includes a first arm 32 connectable with the fist slide assist member 18 and a second arm 34 connectable with the second slide assist member 20, the slide assist lever 30 being operable to move the slide assist members 18, 20 from a first (pre-staged) location to a second (engaged) location with respect to the housing 12 to facilitate mating with the mating connector 28. Each of the first and second slide assist members 18, 20 include a first notch 36 and each of the first and second arms 32, 34 includes a slide sensing protrusion 38, each of which mates with the adjacent first notch 36 when the slide assist member 18, 20 is in the second (engaged) location and the slide assist lever 30 is in the second (engaged) position. When the slide assist lever 30 becomes disconnected from at least one of the slide assist members 18, 20 and an attempt to move the slide assist lever 30 from the first (pre-staged) position to the second (engaged) position does not correspondingly move the disconnected slide assist member 18, 20 from the first (pre-staged) location to the second (engaged) location, the slide sensing protrusion 38 functions to interferingly abut the adjacent disconnected slide assist member 18, 20 thereby preventing the slide assist lever 30 from moving to the second (engaged) position.

As shown in FIG. 1, the connector assembly 10 includes the housing 12, the first and second slide assist members 18, 20, the slide assist lever 30, a terminal retainer 40, a co-molded cable seal and cable strain relief member 42, a connector seal 44, a wire dress cover 46, a secondary lock member 48, and a connector position assurance (CPA) lock 50. The housing 12 generally includes a terminal area 52 and a first shroud 54 along with a channel 56 formed therebetween.

The terminal area 52, the co-molded cable seal and cable strain relief member 42, the connector seal 44, and the secondary lock member 48 are not disclosed in detail herein. The previously cited '376 patent to Fink et al., provides a description of these items.

The secondary lock member 48 is received in a secondary lock passage 58 provided in the first shroud 54 and cooperates with the female terminal retainer 40 in a manner described in the previously cited '376 patent to Fink et al. The connector seal 44 is received in the channel 56 formed between the terminal area 52 and the first shroud 54. An upper portion of the terminal area 52 includes a second shroud (not shown) for receiving the terminal retainer 40 and the co-molded cable seal and cable strain relief member 42 in a manner described in the previously cited '376 patent to Fink et al.

The elements and features along with their interrelationships that are not described in detail herein are not significantly related to the present inventive features and will not be discussed further. The inventive features relate more to the slide assist lever 30, the slide assist members 18, 20, and the connector position assurance lock 50.

The housing 12 has left and right passages 60, 62 respectively formed in first and second opposite sides 54*a*, 54*b* of the first shroud 54, constructed and arranged so that each of the left and right passages 60, 62 may slidably receive therein the respective slide assist member 18, 20, which are mirror images of each other. Each slide assist member 18, 20 is slid into its respective left or right passage 60, 62 and snap fits to prevent backing out via a resilient locking arm 64 which abuttably interacts with a corresponding slot perimeter 66 formed in the housing 12. Each side of the mating connector 28 includes a protrusion 68. Each protrusion 68 deflects a corresponding locking arm 64 as the mating connector 28 is drawn toward the connector assembly 10 during mating, thereby enabling each of the first and second slide assist members 18, 20 to slide within their respective left and right passages 60, 62. Each slide assist member 18, 20 is in the form of an elongated planar body having a pair of like shaped first and second mating slots 22, 24, each having an entry portion 72 and an acutely angled main portion 74, wherein the angular orientations are measured in relation to a slide axis A of the slide assist members 18, 20. Each mating slot 22, 24 is constructed and arranged to receive the mating portion 26 of the mating connector 28 so as to assist the coupling together of the connector assembly 10 and the mating connector 28. The mating portion 26 includes a fist and a second boss 26*a*, 26*b* (as shown on FIGS. 4 and 5) located on each side of the mating connector 28. Each boss 26*a*, 26*b* is received in a respective mating slot 22, 24.

The outer portion of the housing 12 includes a V-shaped pocket 76 formed on the opposite sides 54*a*, 54*b* of the first shroud 54 which respectively communicate with the left and right passages 60, 62. Each of the pockets 40 receives a free end 78 of a respective one of the first and second arms 32, 34 of the slide assist lever 30. Each of the first and second arms 32, 34 of the slide assist lever 30 has a hole 80 formed therethrough near the free end 78 thereof to receive a pivot boss 82 formed on the housing 12 inside the pocket 76.

Figure 4:
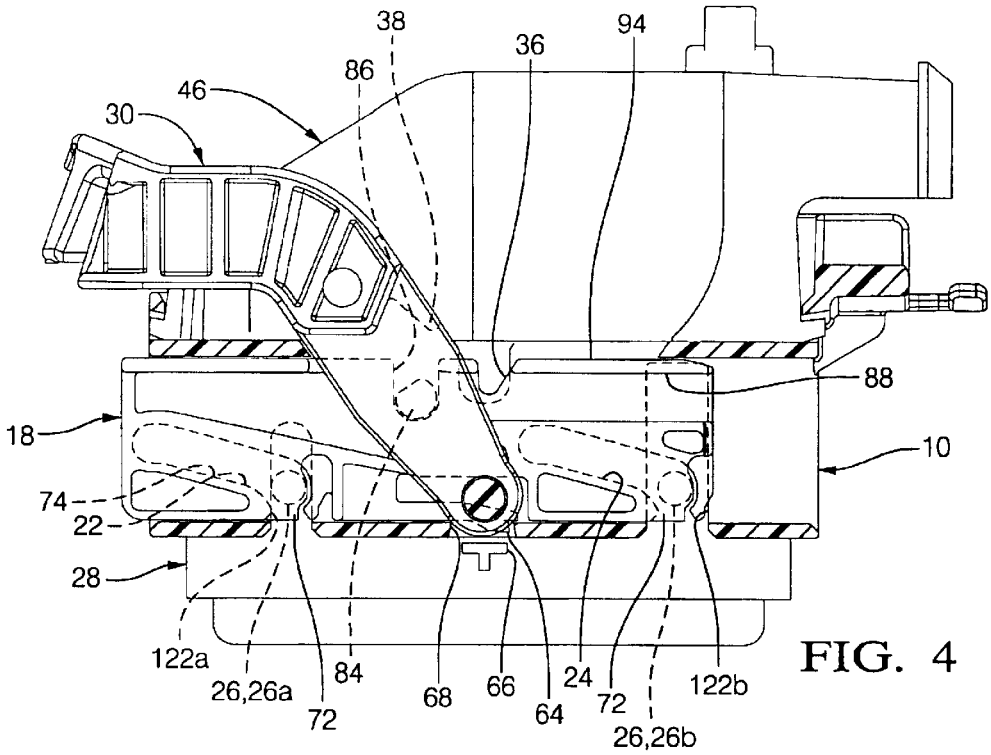
FIG. 4 is a side view of the connector assembly and a mating connector in a first pre-staged state with certain aspects of the connectors shown in section and in phantom.
Figure 5:
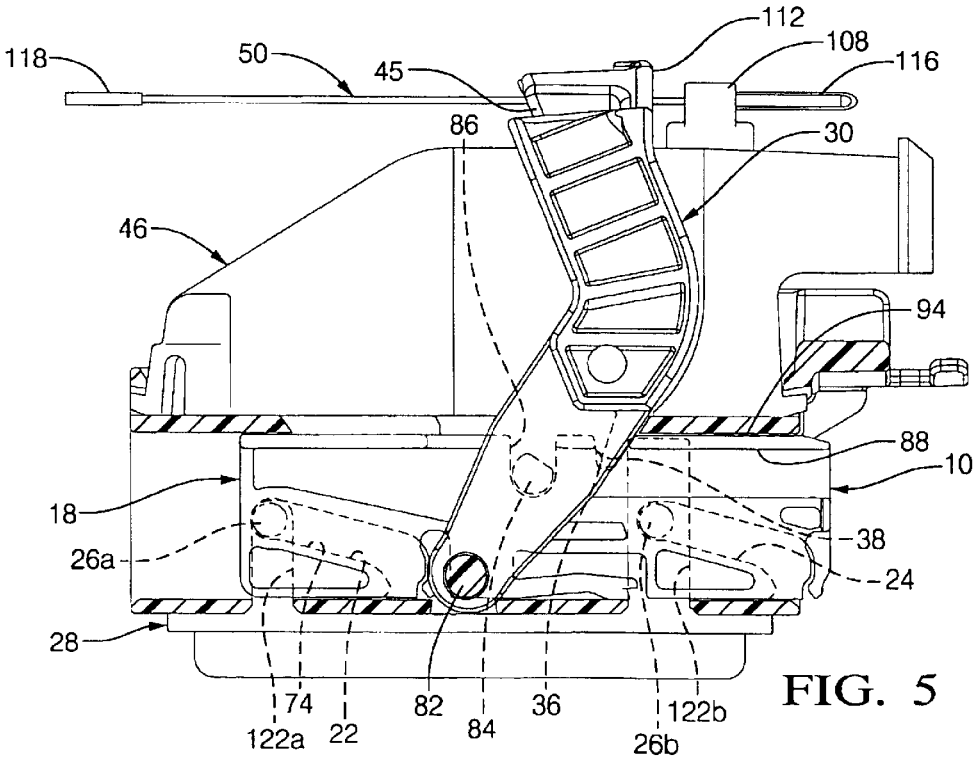
FIG. 5 is a side view of the connector assembly and the mating connector in a mated state with certain aspects of the connectors shown in section and in phantom.

A slide assist push boss 84 is formed on the inside surface of each arm 32, 34 of the slide assist lever 30 to be received, respectively, in a concave second notch 86 formed in each slide assist member 18, 20 for moving the slide assist members 18, 20 between the first (pre-staged) location (see FIG. 4) and the second (engaged) location (see FIG. 5).

In order to slidingly place the slide assist members 18, 20 into their respective left and right passages 60, 62 with the slide assist lever 30 already mounted on the pivot bosses 82, an inclined channel 88 is provided on each the slide assist members 18, 20 so as to slidably engage the slide assist push boss 84 and allow it to enter the concave second notch 86 without interference in the increasing inclination direction, as shown. The inclined channel 88 extends parallel with respect to the slide axis A.

An anti-rotation pad 90 is formed on the inside surface of each arm 32, 34 of the slide assist lever 30. Each anti-rotation pad 90 includes the slide sensing tooth or protrusion 38 to be received, respectively, in the first notch 36 formed in each slide assist member 18, 20 when the slide assist lever 30 is in the second (engaged) position and both of the slide assist members 18, 20 are in the second (engaged) location. Each slide sensing protrusion 38 generally has a V-shape extending along each lever arm 32, 34 with the tip of the "V" pointing generally toward the location (generally shown at 80) where the slide assist lever 30 pivotally connects with the housing 12. The first notch 36 generally has a slanted V-shape, the "V" being slanted with respect to slide axis A. The first notch 36 includes a first side 92 extending perpendicularly with respect to a top surface 94 (as viewed in FIGS. 2 through 5) and a second side 96 extending obliquely with respect to the top surface 94. The first notch 36 is oriented such that the second side 96 extends upwardly and slants toward the direction the slide assist member 18, 20 slides as it moves from the first (pre-staged) location to the second (engaged) location. The slanted second side 96 provides clearance for the slide sensing protrusion 38 to be received into the first notch 36 as the lever arm 32, 34 rotates and the slide assist member 18, 20 slides. Each anti-rotation pad 90 also functions to stiffen each lever arm 32 to reduce bowing that causes the lever arms 32, 34 to spread apart and disengage from the slide assist members 18, 20.

The wire dress cover 46 and the slide assist lever 30 include mutually engaging locking elements for retaining the slide assist lever 30 in each of the first and second positions. In this regard, an aperture 98 is provided on each of the arms 32, 34 of the slide assist lever for engagement with first and second nubs 100, 102 formed in the wire dress cover 46 (see FIG. 2) so as to lightly retain the slide assist lever 30 at the first (pre-staged) position, as shown at FIG. 4 and at the second (engaged) position, as shown at FIG. 5.

Figure 2:
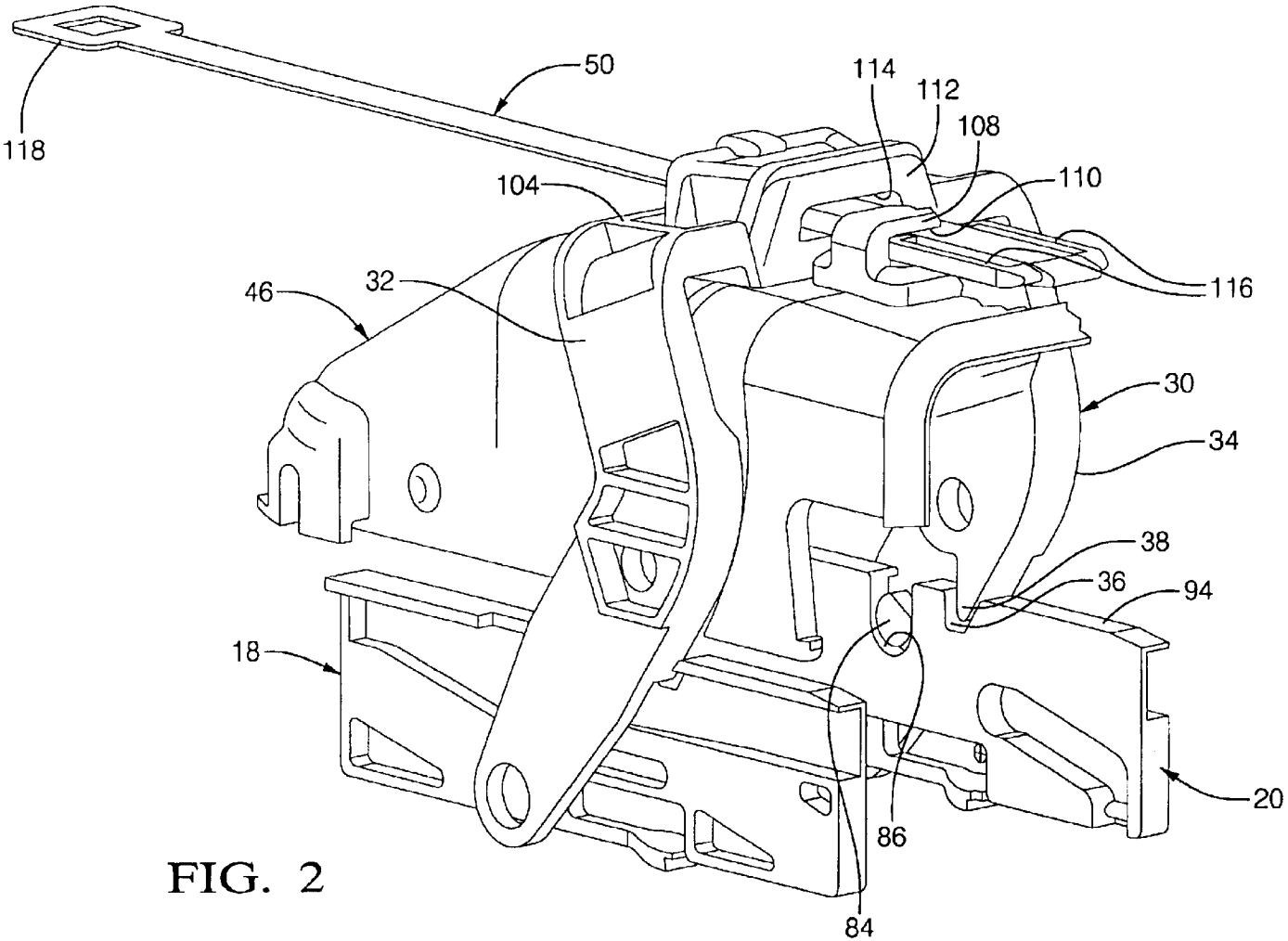
FIG. 2 is a perspective view of a first aspect of the connector assembly.

As shown at FIG. 2, in order to firmly retain the slide assist lever 30 at the second (engaged) position, a bar 104 which connects the two arms 32, 34 engages a resiliently mounted boss (not shown) of the wire dress cover 46. The previously cited '376 patent to Fink further describes and illustrates these features.

As shown in FIGS. 1 and 2, the connector assembly 10 includes a connector position assurance (CPA) lock mechanism. In this regard, the wire dress cover 46 includes a CPA lock feature 108 having a first cavity 110 and the bar 104 of the slide assist lever 30 includes a CPA alignment feature 112 having a second cavity 114. The CPA lock mechanism further includes the elongate, preferably plastic, connector position assurance lock 50 which includes two flexible lock arms 116 on one end, an O-shaped attachment feature 118 on the other end, and a lock tab 120 therebetween. Preferably, two wires (not shown) are routed through the attachment feature 118 to tether the connector position assurance lock 50 to the harness assembly associated with the first connector half 10. The connector position assurance lock 50 is installed when the slide assist lever 30 is at the second (engaged) position. When the slide assist lever 30 is at the second (engaged) position, the first cavity 110 and second cavity 114 align, thereby enabling the connector position assurance lock 50 to be inserted through each of the cavities 110, 114. During installation of the connector position assurance lock 50 the flexible lock arms 116 are inserted through each of the first and second cavities 110, 114. After installation, the connector position assurance lock 50 is held in place by engagement of the flexible lock arms 116 with the CPA lock feature 108 on the wire dress cover 46 and engagement of the lock tab 120 with the CPA alignment feature 112 on the slide assist lever 30. Once the connector assembly 10 and the mating connector 28 are completely engaged and the connector position assurance lock 50 is slid into position, the two connectors 10, 28 are locked in place and cannot be disengaged until the connector position assurance lock 50 is removed.

FIG. 2 illustrates the first and second slide assist members 18, 20, the slide assist lever 30, the wire dress cover 46, and the connector position assurance lock 50 when the connector assembly 10 is in an engaged state. Each slide assist push boss 84 is received in the respective second notch 86. Each slide sensing protrusion 38 is received in the respective first notch 36. The connector position assurance lock 50 is held in place by engagement of the flexible lock arms 116 with the CPA lock feature 108 on the wire dress cover 46 and engagement of the lock tab 120 with the CPA alignment feature 112 on the slide assist lever 30.

Figure 3:
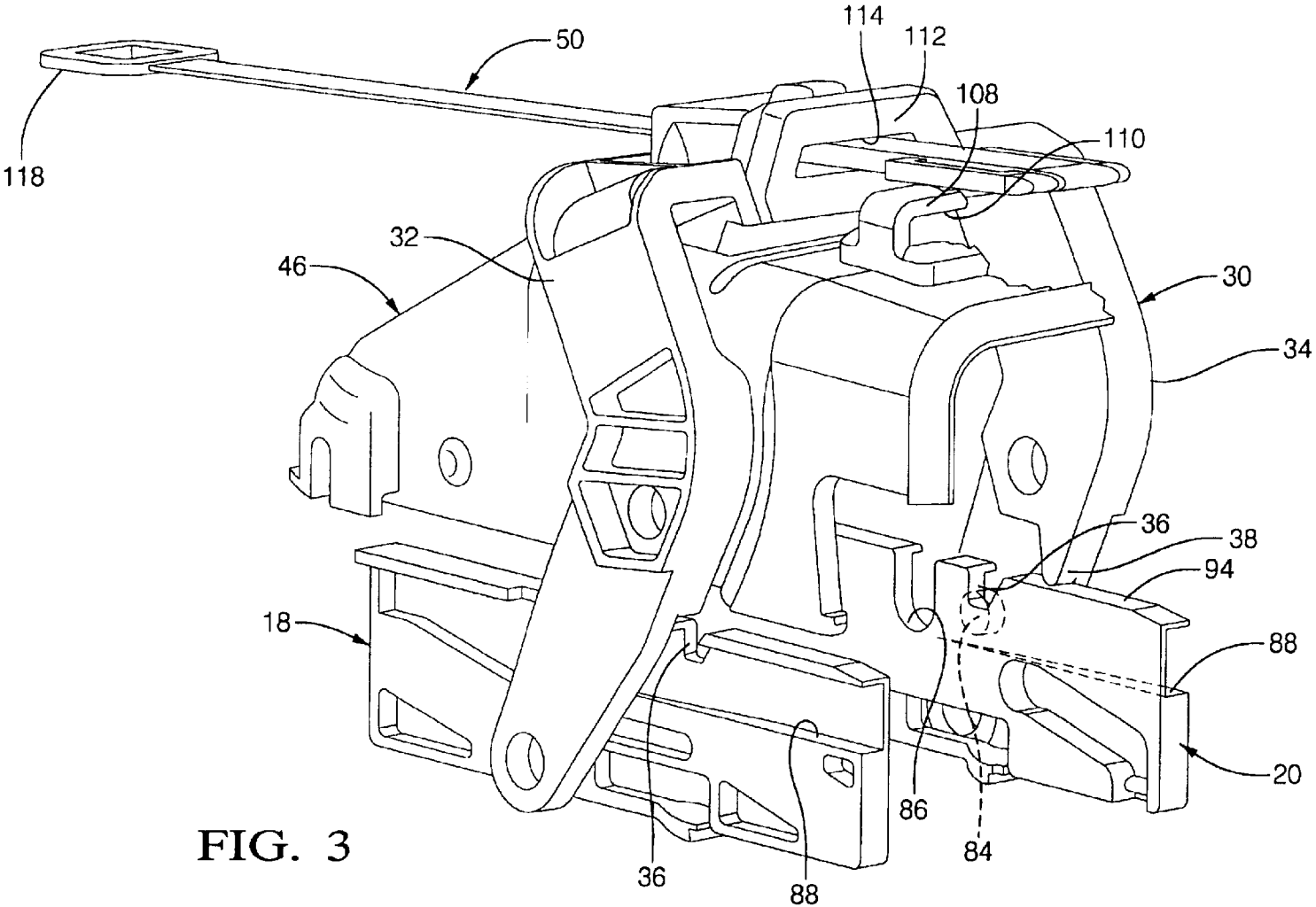
FIG. 3 is a perspective view of a second aspect of the connector assembly.

FIG. 3 illustrates the first and second slide assist members 18, 20, the slide assist lever 30, the wire dress cover 46, and the connector position assurance lock 50 after an attempt has been made to move the slide assist lever 30 to the second (engaged) position and the slide assist push boss 102 on one of the lever arms (second arm 34 in this example) has disengaged from the second notch 86 of the adjacent slide assist member 20. In this state, the slide assist push boss 84 of the second arm 34 is disengaged from the corresponding second notch 86 and the slide sensing protrusion 38 of the second arm 34 abuts the top surface 94 of the corresponding slide assist member 20. The first cavity 110 does not align with the second cavity 114. Consequently, the connector position assurance lock 50 can not engage with both the CPA alignment feature 112 on the slide assist lever 30 and the CPA lock feature 108 on the wire dress cover 46. As shown in phantom, the slide assist push boss 84 is positioned along and captured by the inclined channel 88.

The abutment of the slide sensing protrusion 38 with the respective top surface 94 of the slide assist member 18, 20 prevents movement of the slide assist lever 30 to the second (engaged) position when at least one of the slide assist members 18, 20 does not correspondingly move to the second (engaged) location. As a result, an operator immediately receives feedback that the connectors 10, 28 have not properly mated. The operator can then reattach the slide assist lever 30 to the disengaged slide assist member 18, 20 by moving the slide assist lever 30 back to the first (pre-staged) position. During this movement, the slide assist push boss 84 follows the inclined channel 88 to reengage the concave second notch 86.

Referring now to FIGS. 4 and 5, the operation of the slide assist system of the connector assembly 10 as it relates to the present invention will now be described. The previously cited '376 patent to Fink et al., provides a description of details of the operation that do not relate to the present inventive concept.

As indicated earlier with reference to FIG. 1, the slide assist members 18, 20 each have mating slots 22, 24 having the entry portion 72 and the angled main portion 74, wherein the angular orientation, as mentioned, is defined by the slide axis A of the slide assist members 18, 20. FIG. 4 shows the slide assist lever 30 at the first (pre-staged) position. The entry portion 72 of each mating slot 34 is aligned with a respective primary slot 122*a*, 122*b* formed in the first shroud 54 of the housing 12. Each primary slot 122*a*, 122*b* is constructed and arranged so that a respective boss 26*a*, 26*b* on the mating connector 28 is received thereinto as the mating connector 28 is seated into the connector assembly 10.

Continuing to refer to FIG. 4, a first (pre-stage) state of the connector assembly 10 with respect to the mating connector 28 is shown, wherein the mating connector 28 is intermediately seated into the housing 12 via the channel 56 (not shown on FIG. 4). Each boss 26*a*, 26*b* has passed through the respective primary slot 122*a*, 122*b*, entered into the entry portion 72 of the mating slot 22, 24 and is now stopped at the main portion 74. From the first (pre-stage) position, the slide assist lever 30 may be pivoted to actuate the slide assist system to thereby further seat the mating connector 28 into the connector assembly 10 (any further need for manual pressing of the mating connector 28 into the connector assembly 10 being obviated).

Referring now to FIG. 5, a second (mated) state of the connector assembly 10 with respect to the mating connector 28 is shown. The slide assist lever 30 is shown at the second (engaged) position, whereupon the boss (not shown) of the wire dress cover 46 is snapped onto the bar 104 of the slide assist lever 30 and the mating connector 28 is fully seated with the first connector half 10. At this position, the male and female terminals (not shown) are properly electrically engaged with each other. Each boss 26*a*, 26*b* is fully received in the respective mating slot 22, 24. Each of the slide sensing protrusions 38 is received within the respective first notch 36. The connector position assurance lock 50 is held in place by engagement of the flexible lock arms 116 with the CPA lock feature 108 on the wire dress cover 46 and engagement of the lock tab 120 with the CPA alignment feature 112 on the slide assist lever 30.

This invention has been described with reference to a preferred embodiment and modifications thereto. Further modifications and alterations may occur to others upon reading and understanding the specification. It is intended to include all such modifications and alterations insofar as they come within the scope of the invention. For example, in the preferred embodiment, each of the lever arms extends between the adjacent slide assist member and the adjacent side wall of the housing. It may occur to one skilled in the art to use another configuration. It may also occur to one skilled in the art to mount a slide assist member and a lever having a slide sensing mechanism of the present invention to various types of housings and other structures.

Having thus described the invention, what is claimed is:

1. In an electrical connector assembly for mating with a mating connector, the electrical connector assembly including a housing, a slide assist member slideably supported on the housing to facilitate mating with the mating connector, and a lever pivotally connected with the housing, the lever including an arm connectable with the slide assist member for causing the slide assist member to slide from a pre-staged location to an engaged location with respect to the housing in response to the lever being pivoted from a pre-staged position to a engaged position relative to the housing, the improvement comprising:

the slide assist member including a notch; and the arm including a protrusion which mates with the notch when the slide assist member is in the engaged location and the lever is in the engaged position, the protrusion being functional to interferingly abut the slide assist member and prevent movement of the lever from the pre-staged position to the engaged position when the lever is disconnected from the slide assist member and an attempt to move the lever from the pre-staged position to the engaged position does not correspondingly move the slide assist member from the pre-staged location to the engaged location.

2. The electrical connector assembly as recited in claim 1, wherein the protrusion generally forms a V-shape which extends along the lever arm.

3. The electrical connector assembly as recited in claim 2, wherein the tip of the V generally points toward a location where the lever pivotally connects with the housing.

4. The electrical connector assembly as recited in claim 3, wherein the notch generally has a V-shape for receiving the protrusion.

5. The electrical connector assembly as recited in claim 4, wherein the slide assist member has a first surface for abutment with the protrusion, the V-shaped notch being oriented such that the V-shape is slanted with respect to the first surface.

6. The electrical connector assembly as recited in claim 5, wherein the V-shaped notch includes a first side extending obliquely with respect to the first surface, as the first side extends from the tip of the "V" toward the first surface the first side slants toward a direction the slide assist member slides as it moves from the pre-staged location to the engaged location.

7. The electrical connector assembly as recited in claim 6, wherein the V-shaped notch includes a second side extending perpendicularly with respect to the first surface.

8. In an electrical connector assembly for mating with a mating connector, the electrical connector assembly including a housing having opposing walls and first and second slide assist members slideably supported on the opposing walls, each slide assist member including at least one mating slot adapted to receive a mating portion of the mating connector, the electrical connector assembly further including a lever pivotably interconnected with the housing, the lever including a first arm connectable with the first slide assist member and a second arm connectable with the second slide assist member, the lever being operable to move each of the slide assist members from a pre-staged location to an engaged location with respect to the housing to facilitate mating with the mating connector, the improvement comprising:

each of the first and second slide assist members including a first notch; and each of the first and second arms including a protrusion, each of which mates with the adjacent first notch when the slide assist member is in the engaged location and the lever is in the engaged position, when the lever is disconnected from at least one of the slide assist members and an attempt to move the lever from the pre-staged position to the engaged position does not correspondingly move the disconnected slide assist member from the pre-staged location to the engaged location, the protrusion functions to interferingly abut the adjacent disconnected slide assist member thereby preventing the lever from moving to the engaged position.

9. The electrical connector assembly as recited in claim 8, wherein each slide assist member includes a second notch, each arm includes a boss for engaging the adjacent second notch for moving the corresponding slide assist member, the improvement further comprising each of the slide assist members including a channel extending parallel to a direction of sliding movement of the respective slide assist member, the channel being positioned to capture the corresponding boss when the protrusion abuts the disconnected slide assist member and to guide the boss to the second notch to enable the boss to reengage the second notch when the lever is moved back to the pre-staged position.

10. The electrical connector assembly as recited in claim 8, wherein each protrusion generally forms a V-shape which extends along the corresponding lever arm.

11. The electrical connector assembly as recited in claim 10, wherein the tip of the V generally points toward a location where the lever pivotally connects with the housing.

12. The electrical connector assembly as recited in claim 11, wherein each first notch generally has a V-shape for receiving the corresponding protrusion.

13. The electrical connector assembly as recited in claim 12, wherein each slide assist member has a first surface for abutment with the protrusion, the V-shaped first notch being oriented such that the V-shape is slanted with respect to the first surface.

14. The electrical connector assembly as recited in claim 13, wherein each V-shaped first notch includes a first side extending obliquely with respect to the first surface, as the first side extends from the tip of the "V" toward the first surface the first side slants toward a direction the slide assist member slides as it moves from the pre-staged location to the engaged location.

15. The electrical connector assembly as recited in claim 14, wherein each V-shaped first notch includes a second side extending perpendicularly with respect to the first surface.

16. The electrical connector assembly as recited in claim 8, the improvement further comprising a connector position assurance lock mechanism operable to connect the lever to the housing when the lever is in the engaged position to prevent the lever from rotating to the pre-staged position.

17. The electrical connector assembly as recited in claim 16, the improvement further comprising the connector position assurance lock mechanism comprising a lock feature formed in the housing, the lock feature having a first cavity, an alignment feature formed in the lever, the alignment feature having a second cavity, and a connector position assurance lock capable of extending through the first and second cavities when the lever is in the engaged position, the connector position assurance lock having a first surface for engaging the lock feature and a second surface for engaging the alignment feature.

18. A slide sensing mechanism for a slide member slideably supported on a structure and a lever pivotally connected with the structure, the lever being connectable with the slide member for causing the slide member to slide from a first location to a second location with respect to the structure in response to the lever being pivoted from a first position to a second position relative to the structure, the slide sensing mechanism comprising:

a notch formed in the slide member; and a protrusion located on the lever, the protrusion mating with the notch when the slide member is in the second location and the lever is in the second position, the protrusion being functional to interferingly abut the slide member and prevent movement of the lever from the first position to the second position when the lever is disconnected from the slide member and an attempt to move the lever from the first position to the second position does not correspondingly move the slide member from the first location to the second location.

19. The slide sensing mechanism as recited in claim 18, wherein the protrusion generally forms a V-shape which extends along the lever.

20. The slide sensing mechanism as recited in claim 19, wherein the tip of the V generally points toward a location where the lever pivotally connects with the structure.

21. The slide sensing mechanism as recited in claim 20, wherein the notch generally has a V-shape for receiving the protrusion.

* * * * *